United States Patent [19]

Robinson et al.

[11] Patent Number: 4,844,177

[45] Date of Patent: Jul. 4, 1989

[54] TORQUE SENSING, AUTOMATIC SHUT-OFF AND RESET CLUTCH FOR TOGGLE CONTROLLED SCREWDRIVERS, NUTSETTERS AND THE LIKE

[75] Inventors: Richard D. Robinson, Bryan; Robert A. Willoughby, Mt. Washington; Phil D. Thorp, Bryan, all of Ohio

[73] Assignee: The Aro Corporation, Bryan, Ohio

[21] Appl. No.: 82,686

[22] Filed: Aug. 7, 1987

[51] Int. Cl.[4] ..... B25B 23/145

[52] U.S. Cl. ..... 173/12; 173/169; 173/170; 81/470; 81/473

[58] Field of Search ..... 173/12, 168–170; 81/473, 470

[56] References Cited

U.S. PATENT DOCUMENTS

| | | | |
|---|---|---|---|
| 2,732,746 | 1/1956 | Livermont . | |
| 2,984,133 | 5/1961 | Livermont . | |
| 3,020,789 | 2/1962 | Etzkorn . | |
| 3,034,623 | 5/1962 | Amtsberg . | |
| 3,174,599 | 3/1965 | Spyridakis et al. . | |
| 3,187,865 | 6/1965 | Blachowski . | |
| 3,194,437 | 7/1965 | Bennett . | |
| 3,220,526 | 11/1965 | Gattiker . | |
| 3,262,536 | 7/1966 | Frisbie et al. . | |
| 3,498,389 | 3/1970 | Tibbott . | |
| 3,515,251 | 6/1970 | Clapp . | |
| 3,578,091 | 9/1967 | States | 173/12 |
| 3,710,873 | 1/1973 | Allen | 173/12 |
| 3,741,313 | 6/1973 | States | 173/12 |
| 4,071,092 | 1/1978 | Wallace | 173/12 |
| 4,258,798 | 3/1981 | Campbell et al. | 173/168 |
| 4,631,992 | 12/1986 | Eckman | 81/473 X |

*Primary Examiner*—Frank T. Yost
*Assistant Examiner*—James L. Wolfe
*Attorney, Agent, or Firm*—Allegretti & Witcoff, Ltd.

[57] ABSTRACT

An improved torque control and fluid shut-off mechanism for a fluid operated tool includes a bit holder and driving clutch member which are connected for uniform cojoint axial movement and independent rotary movement. Spring biased ball bearings provides for cojoint rotary movement which is overcome when the spring biasing force associated with the driving clutch member exceeds a threshold level. A locking sleeve fitted over the driving clutch member cooperates with a control rod for the fluid inlet to the rotary vane air motor to control initiation of operation, termination of operation, and resetting of the tool. A toggle-type trigger controls inlet fluid for forward and reverse operation of the tool.

8 Claims, 2 Drawing Sheets

TORQUE SENSING, AUTOMATIC SHUT-OFF AND RESET CLUTCH FOR TOGGLE CONTROLLED SCREWDRIVERS, NUTSETTERS AND THE LIKE

BACKGROUND OF THE INVENTION

This invention relates to a reversible, toggle operated, fluid driven tool such as a screwdriver having a "push to start"; torque controlled, fluid shut-off; and "release to reset" mechanism.

Fluid operated tools for driving fasteners and the like typically incorporate a rotary vane air motor to drive a rotary output shaft. Such tools are often equipped with a torque sensitive clutch mechanism. When a specific resistance to torque is sensed, the clutch mechanism automatically slips and terminates further tool driving force to the fastener.

Starting the tool is often effected by positioning a tool bit against the fastener and axially translating the bit by pushing it against the fastener. Axial translation of the bit operates a mechanism which opens a fluid supply valve to the tool. Such a tool is often referred to as a "push to start" controlled tool.

To combine start up control, torque control and automatic shut-off in a single tool is a desirable goal. In fact, many tools include torque responsive shut-off mechanisms sometimes coupled with a "push to start" mechanism for initiating operation of the tool.

It is also desirable to have all of the tool operations, including starting the tool, torque control and shut-off as well as resetting, associated merely with the activity of placing the tool against a fastener or removing the tool from a fastener, i.e. "push to start—release to reset". Various prior art references disclose devices of this general nature. Of particular pertinence is U.S. Pat. No. 4,576,270 issued Mar. 18, 1986 for a torque control and fluid shutoff mechanism for a fluid operated tool. That application and the references cited therein are incorporated herewith by reference.

U.S. Pat. No. 4,576,270 teaches the use of a bit which is axially translatable (push to start) in order to open the inlet valve to the tool for operation of a rotary vane air motor. A clutch mechanism in the tool comprises opposed, interlocking jaws which are associated with a bit holder and drive shaft respectively. Upon reaching a threshold torque, the jaws separate by rotating relative to one another thereby causing the drive shaft to disconnect from the bit holder and the inlet valve to close and terminate fluid flow to the rotary vane air motor. Subsequent release of the bit from the fastener resets the tool for further operation.

Such tools do not normally include a toggle operated or reversible trigger operated control switch because of the redundancy that results from a trigger control and push to start control. On the other hand, toggle or trigger operated tools may include a torque sensing or limiting feature. Toggle or trigger controlled tools are disclosed in U.S. Pat. Nos. 3,578,091; 3,710,873 and 3,741,313.

While the tools disclosed in the aforesaid patents are quite useful, an improved mechanism is desired having a simple, push to start operation, torque control, a reversible trigger or toggle switch control, and also having a reset capability associated with removal of the tool from a fastener. These are among the features and advantages which inspired the development of the present invention.

SUMMARY OF THE INVENTION

Briefly the present invention comprises a reversible toggle or trigger operated, fluid powered tool of the type including a housing with a fluid driven motor within the housing. The motor has a rotary output shaft defining a longitudinal axis of rotation for the tool. A fluid inlet is provided to the housing and connects to first and second passages both of which lead to the motor.

The first passage provides fluid for forward operation of the tool. A toggle switch operated or trigger operated first valve and a "push to start" operated valve are arranged in series in the first passage. Both valves must be open to permit forward operation of the motor. The trigger operated first valve is manually operated. The push to start valve opens in response to placement of the tool bit against a fastener and subsequent axial movement of a tool bit.

The second passage provides fluid for reverse operation of the motor. The manually controlled toggle switch or trigger operates a second valve to control fluid flow exclusively through the second passage. The toggle switch is constructed so that only one trigger operated valve may be open at any given instant.

A bit holder for the tool bit at the forward end of the tool is aligned axially with the motor output shaft. A clutch mechanism is positioned intermediate the bit holder and the output shaft and serves to mechanically connect that shaft with the bit holder. Thus, the motor output shaft, the bit holder and the clutch mechanism are substantially coaxial. A transmission may be interposed between the motor output shaft and the clutch mechanism.

A torque responsive, fluid flow start, shut-off and reset assembly is incorporated with the clutch mechanism and bit holder. In one embodiment, a first assembly is used. The assembly includes cooperating balls or bearings to effect coupling between the bit holder and a clutch or driving member. The bit holder is thus supported in the housing for axial as well as rotary movement. The bit holder acts as the driven member of the clutch mechanism and includes a flange or plate transverse to the axis with a series of pockets equally, radially spaced around the flange. A driving clutch member is coupled to the bit holder for simultaneous axial movement therewith. The clutch member is driven by the motor as it is keyed or coupled at the end opposite the bit holder to the output shaft of the motor.

The clutch member though generally coupled to the bit holder for rotary movement is also rotatable with respect to the bit holder. To effect rotary coupling, the clutch member includes a series of biased ball members which are retained in passages of the driving clutch member and project therefrom to engage pockets defined in the driven bit holder. During normal operation, rotary output of the driving clutch member is imparted to the driven bit holder, and thus the bit as well as a fastener, due to the engagement of the ball members in the bit holder pockets. When a threshold torque is reached, the ball members slide out of the pockets permitting the clutch member to rotate relative to the bit holder and thereby terminate the rotary driving action of the bit holder. Simultaneously this causes disengagement and closing of the motor inlet valve by effecting displacement of a control or kickout sleeve axially.

The specific mechanism for closing the motor valve member and thereby terminating fluid flow to the motor includes a valve control rod positioned within a counterbore in the driving clutch member. The valve control rod is biased axially into the counterbore and impinges against a radially displaceable bearing positioned in a radial passage extending from the counterbore. The bearing cooperates with the kickout sleeve slidable on the outside of the driving clutch member. The kickout sleeve is designed to maintain the bearing in one of two positions: (1) a radial inward position (associated with coupling of the clutch member and bit holder) which maintains the control rod axially extended and in position for moving the motor control valve to an open condition, and (2) a radial outward position (associated with decoupling of the clutch member and bit holder) which permits release of the control rod for axial movement and consequent closing of the motor inlet valve.

In another embodiment of the invention, the clutch assembly used is that which is described in U.S. Pat. No. 4,576,270. Both embodiments of the assembly thus combine a number of features in a unique fashion, utilizing fewer parts, the parts all being interrelated to control not only air flow to the motor but the maximum torque of the tool. The invention of a combination of either assembly with a toggle control thus results in a single tool which provides for initiation of operation of the motor, termination of operation of the motor once a threshold torque has been sensed, resetting of the torque control and air inlet to the motor once the tool has been removed from engagement with a fastener, and independent reverse operation of the motor.

Thus, it is an object of the invention to provide an improved torque responsive, fluid powered tool which terminates torque driving output from the tool upon sensing a threshold torque level.

Another object of the invention is to provide an improved torque responsive, fluid powered tool wherein the tool bit is translated axially in order to initiate operation of the tool by opening the motor control valve to the air motor for the tool.

It is a further object of the invention to provide an improved torque responsive, fluid powered tool wherein sensing of the threshold torque is effected by cooperative interaction between a bit holder and a driving clutch member interconnected by means of a biased ball member.

Yet another object of the invention is to provide an improved torque responsive, fluid powered tool wherein sensing of threshold torque by a cooperative driving member and bit holder or driven member also acts to release a motor inlet control valve thereby shutting off fluid supply to the motor.

A further object of the invention is to provide a torque responsive, fluid powered tool which automatically terminates operation of the powered tool upon sensing a threshold level of torque and which is resetable upon termination of fluid supply to the motor of the tool followed by mechanical release of the tool from the fastener upon which the tool has been operating.

Yet another object of the invention is to provide an improved torque responsive, fluid powered tool having a simplified construction, a minimum number of parts and which is rugged, easy to repair, and easy to use.

Another object of the invention is to provide a fluid powered tool having an adjustable clutch which is substantially independent of the motor in the tool.

A further object of the invention is to provide a toggle or trigger switch control, for the described torque control tool, which provides for reverse operation of the tool.

Another object of the invention is to provide a two position trigger switch which provides for direct fluid flow input to impart reverse operation of the motor and which also provides for forward operation of the motor only upon opening of a toggle controlled valve and separate opening of a motor control valve in series within the toggle controlled valve, the motor control valve being responsive to actuation by "push to start" axial movement of the bit holder of the tool.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENTS

The First Embodiment

Figures 1, 2:
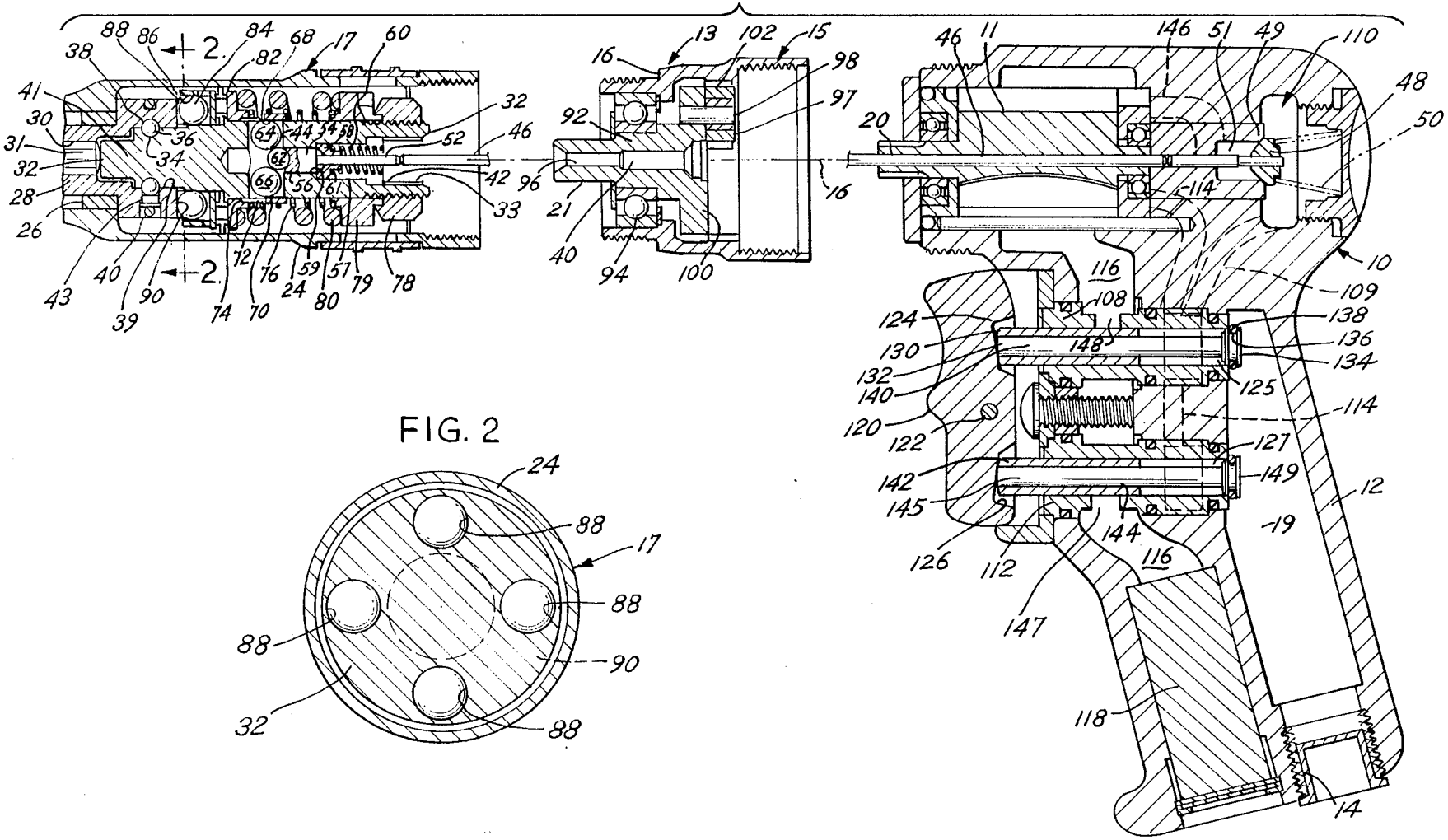
FIG. 1 is a partially exploded cross sectional view along its longitudinal axis of a first embodiment of a rotary vane, air motor driven, fastening tool incorporating the invention.
FIG. 2 is a transverse cross sectional view of the tool of FIG. 1 taken substantially along the line 2—2.

FIG. 1 is a partially exploded cross sectional view of a first embodiment of a pneumatic tool which incorporates the improved, manually operated, toggle switch, torque sensing, start up, shut off, and reset mechanism of the present invention. The tool includes a main housing 10 having an integral handle section 12. Main housing 10 retains a fluid driven, vane motor 11. A separate transmission section 13 has a housing 15 which is threadably attached to housing 10. A forward clutch assembly 17 has a housing 24 which is threadably coupled to transmission section 13 thereby providing an assembled tool.

The assembled main housing 10, transmission section 13, and clutch housing and assembly 17 are generally symmetrical about an elongated center line axis 16 which runs the length thereof. The center line axis 16 is the axis of rotation of the rotary vane, fluid driven motor 11. An output shaft 20 from the motor 11 drives gearing within the transmission section 13. The transmission section 13, in turn, has an output shaft 21 which is splined to a driving clutch member 32 which drives a bit holder 28 and a bit 31. In general, therefore, there are three separate sections of the tool: (1) a forward clutch assembly 17; a transmission section 13; and a main housing 10 which incorporates a handle section 12 as well as the rotary vane motor 11.

1. The Clutch Assembly

The clutch assembly 17 includes a housing 24 threadably attached to the section 13. Cylindrical housing 24 extends from the section 13 forward and includes bit holder bearings 26 internally mounted at the forward end of housing 24. Bearings 26 support bit holder 28 permitting that bit holder 28 to rotate about the axis 16 on the bearings 26 while moving axially within housing 24 in the direction of the axis 16. Bit holder 28 includes a forward keyed passage 30 for receipt of a bit 31 for driving a fastener, for example.

Within housing 24 and intermediate the bit holder 28 and the output shaft 21 of the transmission section 13 is the clutch mechanism, reset assembly and torque sensing mechanism of the invention. This assembly includes a driving clutch member 32 which is counterbored with a keyed passage 33 at one end to receive the shaft 21. Member 32 is rotational with respect to the bit holder 28 but is coupled for axial movement with the bit holder 28.

The clutch member 32 thus includes a peripheral, circumferential groove 34 into which ball bearings 36 are positioned to cooperate with an internal, circumferentially complementary locking groove 38 in an axial throughbore 39 in the bit holder 28. The forward end 41 of clutch member 32 fits into counterbore 39. The bearings 36 which lock bit holder 28 to clutch member 32 are fitted through a radial passage in the bit holder 28 and are retained in position by a pin 43 held by spring clip 40. In this manner the clutch member 32 is coupled to bit holder 28 for cojoint axial movement while simultaneously permitting rotation of member 32 about axis 16 relative to the bit holder 28. Thus, the clutch member 32 and bit holder 28 always move cojointly forward or rearward in the axial direction. For example, axial force against a bit 31 as shown in FIG. 1 retained in the keyed bit opening 30 engages the bit 31 against forward end of the clutch member 32 and causes the clutch member 32 and bit holder 28 to move together rearward along axis 16 or to the right in FIG. 1. As described in detail below, the holder 29 and member 32 are normally biased forward or to the left in FIG. 1 by spring 60.

At the opposite end of the clutch member 32, counterbore 33 receives the drive shaft 21 of the transmission section 13. The drive shaft 21 is keyed or splined to the counterbore 33. The counterbore 33 connects to a coaxial cylindrical passage 57 which, in turn, connects to a lesser diameter coaxial, cylindrical passage 59.

A control rod 52 which is retained within the counterbores or passages 57, 59. The rod 52 includes a large forward diameter end 54 cooperative with and slidably received in passage 59. An annular seat member 58 is spring biased by the coil spring 60 fitted around rod 52 against the internal land or flange 61. Spring 60 is held against seat member 58 by the forward end of the shaft 21. Thus, spring 60 drives holder 28 and clutch 32 in the forward direction axially.

A ball bearing 62 is engaged by the forward end 54 of the rod 52. Bearing 62, in turn, engages first and second transverse balls or ball members 64 and 66 fitted within the radial or transverse passage 44 and forces those ball members 64, 66 radially outward against a first limiting internal, circumferential surface 68 of an annular kickout sleeve 70. The sleeve 70 includes an inclined surface 72 which connects with a second, internal limiting surface 74 having a greater diameter than the first limiting surface 68. The kickout sleeve 70 is normally biased in the forward axial direction against a thrust bearing assembly 82 by means of a biasing spring 76 which is engaged by an adjustable washer 79 and nut 78 threaded on the outside of the clutch member 32.

The adjustable nut 78 also engages a second clutch biasing spring 80 that engages against roller thrust bearing assembly 82. Assembly 82 is axially slidably mounted on the outside of the clutch member 32 and has a surface or side disposed against ball bearings 84. Each ball bearing 84 is slidably received in a compatible, axial, cylindrical passage 86 of clutch member 32. Passages 86 are radially spaced from the axis 16 uniformly about the axis 16. Thus, as shown in FIG. 2, four bearings 84 are equally spaced, radially around the member 32.

The bearings 84 engage in pockets 88 defined in a circumferential flange surface 90 of the bit holder 28. Surface 90 is transverse to axis 16. The spring 80 thus biases the ball bearings 84 into the pockets 88 during normal operation of the tool.

Control rod 52 is axially aligned and coacts with a valve control rod 46. Valve control rod 46 extends through an axial passage 40 in shaft 21 of transmission section, through a passage in the drive shaft 20 of motor 11 and connects at the rear end of the tool with a valve member 48. The valve member 48 is biased by a spring 50 toward the closed position upon a seat 49 of inlet passage 51.

2. The Transmission Section

The transmission section 13 includes the housing 17 with a driven spindle 92 mounted on a roller thrust bearing assembly 94 retained within the housing 17. The output shaft 21, as previously described, is keyed into counterbore 33 for cooperation with the driving clutch member 32. Further, the spindle 92 includes a throughbore or passage 96 which lies on the axis 16 for receipt of the rod 46. The spindle 92 has an eccentrically mounted spur gear 97 on a pin or shaft 98 attached to the plate 100 of the spindle 92. The gear 97 is mounted on a bearing 102 affixed to the shaft 98. The spur gear 97 cooperates with the gear teeth of the output shaft 20 of the motor 11. Thus, as the air motor 11 drives the shaft 20, the shaft 20 gear teeth engage teeth of the gear 97 thereby driving the spindle 92. In this manner a gear reduction is provided through the transmission section 13. Clearly other transmission sections or assemblies may be substituted for that which is described. Importantly, with all such transmission assemblies, it is necessary for the center passage 96 to be provided for passage of a control rod 46.

3. The Main Housing

The main housing 10 includes the handle 12 with a fluid inlet 14 connected to the inlet reservoir and passage 19, an annular valve guide 108 defines, in part, a passage from the reservoir 19 to the forward fluid inlet chamber 110 which is upstream from the valve 48. Thus, fluid flows through the reservoir 19 and the guide 108, then via passage 109 into the chamber 110. Upon opening of the valve 48, it flows to the motor 11 to drive the motor 11 in the forward direction. In such circumstance, primary exhaust air from motor 11 flows through exhaust passage 116, thence through filter 118 for discharge from the tool. Secondary exhaust air from motor 11 flows through passage 114 to annular space 127. It then exits through an exhaust opening 147 in a second guide 112 which, in part, defines annular space 127 since air pressure forces the cylindrical sleeve 142 retained by guide 112 outward to expose the passage or opening 147. Passage 147 connects with passage 116, filter 118 and to atmosphere.

The second guide 112 is thus arranged parallel to the first guide 108 and also connects to the pressurized fluid flow inlet reservoir 19. The second guide 112 connects to a second passage 114 which connects with the motor 11 to drive the motor in the reverse direction. In this circumstance, primary exhaust air from the motor 11 flows through the exhaust passage 116, through an exit filter 118 and then to the atmosphere. Secondary exhaust air from motor 11 flows through passage 146, around valve 48 into chamber 110 exiting via passage 109 to annular space 125 in guide 108 around a stem 140. The fluid then exits through exhaust opening 148 which is, in such circumstance, communicating with space 125 since the cylindrical sleeve 130 is air biased to the left in FIG. 1 within the guide 108. Exhaust fluid then passes into chamber or passage 116 to the atmosphere.

A special toggle switch or manually operated trigger mechanism controls valves within the separate guides 108 and 112 to thereby control forward or reverse operation of the tool. Specifically, a finger actuated toggle 120 is mounted to pivot about a shaft 122 supported on the handle 12. The trigger 120 includes first and second pockets or detents 124 and 126 for engaging an assembly which opens and closes a forward port 125 and a reverse port 127 and exhaust passages or ports 147, 148 associated with flow of fluid to and from passages 109, 114 respectively from the reservoir 19 and motor 11.

Thus, pocket 124 cooperates with a foreshortened cylindrical or tubular sleeve 130 which is slidably positioned within a cylindrical passage in the guide 108. Sleeve 130 receives a stemmed valve member 132. Stemmed valve member 132 includes a valve plate 134 with a circumferential groove 136 that receives a sealing 0-ring 138. A stem 140 projects from the plate 134 into the center passage in sleeve 130 and is slidably received thereby. Sleeve 130 and stem 140 move cojointly to the right in FIG. 1 in response to manual actuation of trigger 120. Sleeve 130 thus provides a seal between the stem 140 and the atmosphere so that fluid flow from the reservoir 19 will not flow out past the stem 140. Movement of the sleeve 130 and stem 140 to the left in FIG. 1 is dependent upon air pressure acting thereon. Pressure on plate 136 tends to move the stem 140 to the left. Pressure on the annular, inside end surface of sleeve 130 likewise biases the sleeve 130 to the left.

In a similar fashion, the pocket 126 has associated therewith a sleeve 142 and cooperative valve member 144 with a stem 145 and valve plate 149. Pressure in the reservoir 19 acts against the plate 149 mounted on stem 145 to drive the valve member 144 to the closed position illustrated in FIG. 1. Pressure on the inside annular end of the sleeve 142 likewise drives the sleeve 142 to the left in FIG. 1 to the extent permitted by the toggle 120.

Manual actuation of the trigger 120, for example against the stem 140 and sleeve 130, will cause the stem 140 to drive the plate 134 out of engagement with the associated port 125 in the guide 108. Pressurized air will then be provided to the passage 109 and chamber 110. Simultaneously, sleeve 142 is biased by air pressure to the left. This opens exhaust port 147. Of course, when in this position, the trigger 120 cannot open the valve member 144 associated with reverse operation of the motor 11. Also, exhaust port 148 is sealed by sleeve 130.

Pivoting the trigger 120 in the opposite direction about the pin 122 will, however, cause the forward valve 132 to close and sleeve 142 to close the port 147 as the reverse valve member 144 opens and sleeve 130 opens the port 148.

b 4. Operation

Pressurized air enters through the inlet 14 and pressurizes the reservoir or passage 19. However, flow from the passage 19 to the motor is normally blocked by the motor valve 48 as well as valve member 132. Motor valve 48 is actuated by engaging the bit 31 of the tool with a fastener, for example. In turn, bit 31 held in the bit holder 28 will force the bit holder 28/clutch member 32 axially rearward against the force of the spring 60. As the bit holder 28/clutch member 32 are forced in a rearward direction, the rod member 52, which is carried by the clutch member 32 in the fixed position depicted in FIG. 1, drives the valve control rod 46 rearwardly thereby opening the valve 48 against the force of spring 50. The rod 52 is held in position inasmuch as the sleeve 70 holds the bearings 64 and 66 as well as the ball 62 in the position shown in FIG. 1 against the rod 52.

Thus, the resistance to rearward axial motion of the bit holder 28 and clutch member 32 is supplied by the spring 60 within the counterbore 42 and spring 50 acting on valve 48. This resistance is overcome by manually forcing the bit 31 against the fastener which is to be fastened. This, as previously explained, opens the valve 48 permitting pressurized air to flow to the rotary vane air motor 11 provided, of course, that chamber 110 is receiving pressurized fluid.

Pressurized air is provided in chamber 110 by actuation of the toggle or trigger 120 so as to pivot the trigger 120 simultaneously against the stem 140 and the sleeve 130. Such actuation causes a number of events. First, exhaust port 148 is closed by sleeve 130. Second, such actuation allows sleeve 142 to move forward to the left in FIG. 1 maintaining contact with pocket 126 and opening exhaust port 147 to allow transmission of exhaust from passage 114 and 127 to combine with exhaust in passage 116. Third, the valve member 132 opens permitting air flow to chamber 110. Thus, initiation of the air motor 11 can commence but only when the trigger 120 is operated and the bit holder 28/clutch member 32/rod 52 are simultaneously transported axially in the rearward direction, i.e. "pushed to start".

Rotary output of motor 11 is then transmitted via shaft 20 through the transmission section 13, via shaft 21 to the clutch member 32 and thence to the bit holder 28 through the balls or ball bearings 84 which are retained in position by action of the spring 80 acting thereon retaining them in the pockets 88. The pockets 88 are shaped to be complementary or cooperate with the bearings 84. In the figures, the pockets 88 are hemispherical in shape. However, they may be of any desired shape such as scalloped or scooped to permit movement of the bearings 84 from the pocket 88 to the surface 90 in a controlled fashion. Numerous other configurations of the pockets 88 and bearings 84 are possible. Also note that the nut 78 and washer 79 are threadably adjustable on the clutch member 32 to thereby vary the biasing load on the spring 80. This enables adjustment of the biasing forces of bearings 84 in pockets 88 or, in other words, provides a means for adjustment of the level or magnitude of torque sensed before the tool shut off.

In any event, when the torque resistance of a fastener increases to a threshold level, the balls 84 climb out of the pockets or depressions 88 onto the surface 90 of the bit holder 28. This causes the bit holder 28 to be rotationally displaceable relative to the clutch member 32 thereby terminating torque application to the fastener.

The movement of balls 84 onto surface 90 axially translates the race and thrust bearing 82 to the right in FIG. 1 compressing the spring 80. This simultaneously transports the sleeve 70 to the right or rearwardly over the clutch member 32 inasmuch as the sleeve 70 is engaged by the race and thrust bearing 82. The sleeve 70, though biased by spring 76, moves axially rearwardly thereby permitting the balls 64 and 66 to move radially outward in passage 44 to the second limiting position defined by the surface 74. The balls 64, 66 do, in fact, move radially outward drive apart by ball 62 which is driven by the end 54 of rod 52. Rod 52 is driven by rod 46 biased by spring 50. As the valve rod 46 moves to the left, the valve 48 closes. This terminates flow of pressurized air flow from chamber 110 to the motor 11. Rotary output from the shaft 20 thus ceases.

When the motor 11 has ceased operation, then the balls 84 will continue up the ramp and roll over the top of the surface 90 into the depressions 88 or, alternatively, will roll back into the depressions 88. This causes axial displacement of the thrust bearing 82 to the left due to the pressure of the associated spring 80. However, the sleeve 70 will remain in position and will not return to its original position shown in FIG. 1 inasmuch as the balls 64 and 66 are maintained in a radially outward or radially extended position. This occurs because the bit holder 28/clutch member 32 continue to be pressed against the fastener. Because the bit holder 28/clutch member 32 are pressed against a fastener, the rod end 54 cannot effectively retract into passage 59. Thus, ball 62 is held by end 54 forcing balls 64, 66 outwardly thereby locking sleeve 70 in position.

The sleeve 70, however, is released by balls 64, 66 once the tool is manually removed from the fastener against which it was impinged. In other words, release of axial force on bit holder 28/clutch member 32 permits spring 60 acting on flange or land 61 to drive the clutch member 32/bit holder 28 in the forward axial direction thereby permitting translation of the member 32 relative to rod end 54 to the position shown in FIG. 1. This effectively releases the ball 62, in turn, releasing balls 64, 66 to move radially inward, permitting sleeve 70 to move forward so that the device is reset for the next fastening operation.

The same fastening operation can then be performed on the next fastener inasmuch as the described operation set forth provides for one cycle of operation. The trigger 120, during this cycle, can remain depressed for forward operation. Thus, cycling depends upon "push to start" and "release to reset" operation. Release of the trigger 120 will, however, cause termination of air flow to motor 11 and operation of the tool regardless of "push to start" operation.

To reverse the operation of the motor 11 at any time, the trigger 120 is pivoted about shaft 122 causing pocket 126 to engage stem 145 and sleeve 142 thereby closing port 147. This opens the reverse inlet valve member 144. Pressurized air then flows directly via passage 114 to the motor 11 for reverse operation. Exhaust air from motor 11 returns via port 146, bypassing valve 48 into cavity 110, through port 109 into chamber 125. This pressure causes sleeve 130 to translate to the left contacting pocket 124 and opening port 148 to exhaust. Simultaneously, of course, the sleeve 130 and stem 140 are released by the trigger 120 closing valve 134 permitting passageway 109 to close and terminate fluid flow for forward operation of the motor 11.

In sum then, operation of the tool in the forward direction is effected only upon actuation of the trigger 120 and simultaneous engagement of the bit holder 28 with a fastener thereby moving the bit holder 28 rearwardly in it associated housing. Operation of the tool in the reverse direction is effected only by actuation of the trigger 120. The clutch mechanism also provides for termination of operation of the tool upon sensing an adjustable threshold level of torque, and automatic resetting of the tool upon release from the fastener.

The Second Embodiment

Figure 3:
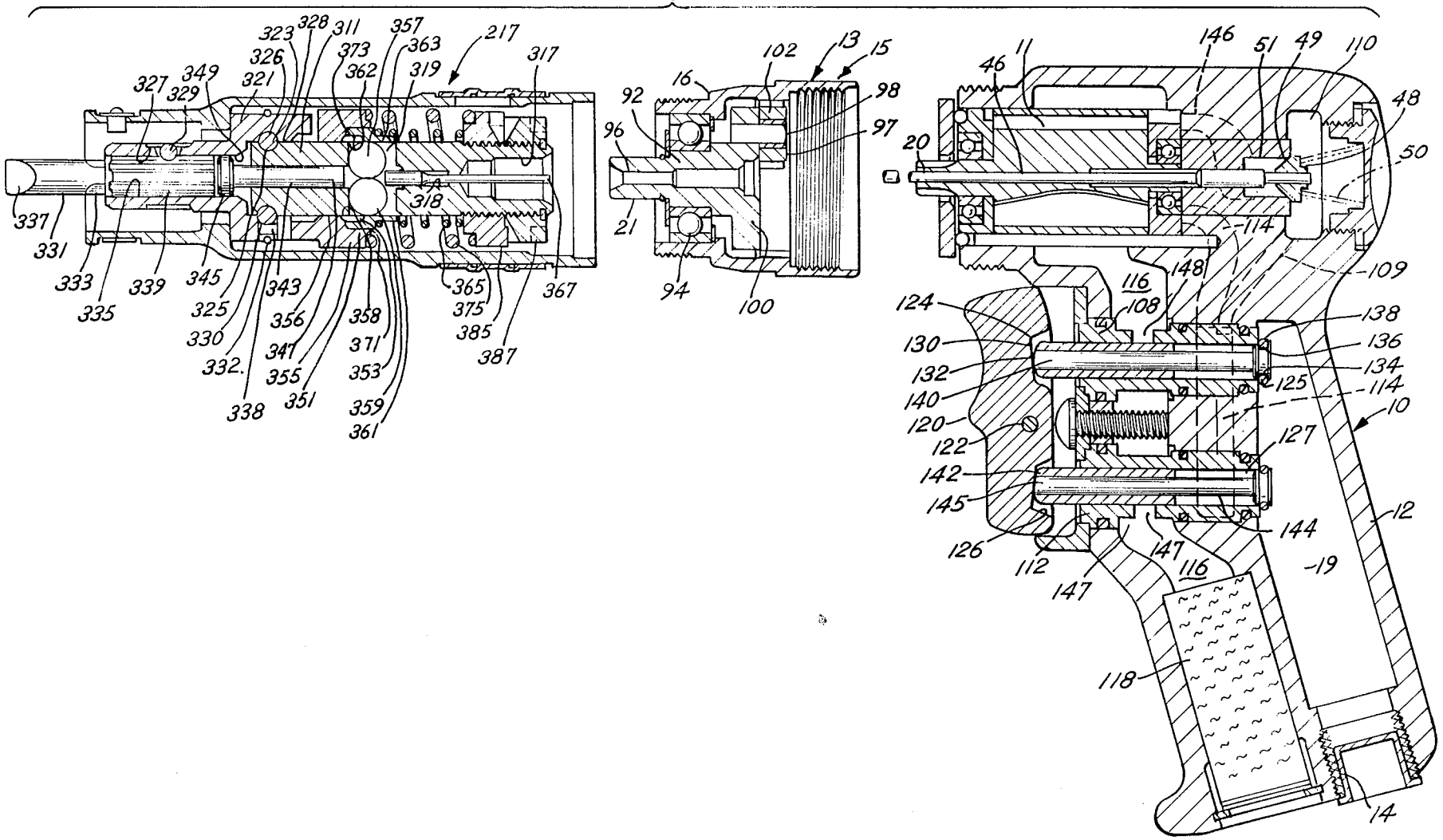
FIG. 3 is a partially exploded cross sectional view along its longitudinal axis of a second embodiment of a rotary vane, air motor driven fastening tool incorporating the invention.

The second embodiment, illustrated in FIG. 3, is very similar in configuration and construction to the first embodiment previously described. The second embodiment includes an identical or substantially identical handle and motor assembly 10, an identical or substantially identical transmission assembly or section 13 and a clutch assembly 217 having a construction as taught in U.S. Pat. No. 4,576,270. Thus, the clutch assembly mechanism 217 of the second embodiment is substituted for the assembly 17 depicted for the first embodiment in FIG. 1.

1. The Main Housing and Transmission Section

The construction of the main housing 10 and transmission section 13 heretofore described with respect to the first embodiment applies with respect to the second embodiment. The construction of the clutch mechanism 217 is as described in U.S. Pat. No. 4,576,270 and is incorporated herewith by reference. The tool of FIG. 3 thus functions in substantially the same manner as the tool of FIG. 1. That is, the tool has a "push to start", "release to reset" function. It has a torque sensing clutch mechanism. The tool is operated in the forward direction only when the toggle trigger 120 is actuated and the valve 48 is simultaneously open due to the push to start mechanism. Reverse operation is effected by operation of the toggle trigger 120 alone.

Following therefore is a short description of the construction of the clutch assembly 217.

2. The Clutch Assembly

The spindle 311 includes an axial throughbore 317 of varying diameter along its length to receive various component parts to be described. Intermediate the ends of the spindle 31 is a transverse passage 319 which intersects throughbore 317. The throughbore 317 thus extends on opposite sides of the passage 319.

A tool bit holder 321 is coupled with the shaft or spindle 311 by means of ball bearings 323 which ride in opposed annular grooves 325, 326 defined respectively in the end of the shaft 311 and on the inside of bore 328 of holder 321. A pin 338 and spring clip 332 retain the balls 323 in grooves 325, 326. In this manner the shaft 311 may rotate with respect to the tool bit holder 321.

Tool bit holder 321 includes a retaining clip 327 which cooperates with a ball 329 to retain a tool bit 331. In this instance a tool bit 331 with an end blade 337 is provided. The tool bit 331 is keyed by means of its hexagonal body 333 with the complementary passage 335 defined in the end of the bit holder 321. The passage 335, as well as the bit holder 321, are coaxial with the throughbore 317. The tool bit 331 includes an intermediate annular groove 339 in body 333 cooperative with the ball 329. The annular groove 339 is oversized with respect to the diameter of the ball 329 so that the tool bit 331 may translate axially for a distance limited by the cooperative action of the ball 329 with the groove 339.

A thrust pin 343 partially extending into throughbore 317 includes a flanged head 345 and an elongated stud section 347. The head 345 is cylindrical in shape and fits within a compatible cylindrical counterbore 349 within the tool bit holder 321. The stud 347 fits within throughbore 317 adjacent the end of shaft 311. The stud 347 as well as the throughbore 317 are of circular cross section.

The bit holder 321 includes an annular cam or bearing surface 351 cooperative with a cam or bearing surface 353 defined on a cam sleeve 355 positioned on the shaft 311 to define a sleeve release mechanism. The cam sleeve 355, has a hexagonal internal cross section 356 complementary for keying with the outer hexagonal cross section 358 of the shaft 311 adjacent the cam sleeve 355. In this manner the cam sleeve 355 which serves as a driver member is rotatable with the shaft 311 and is translatable axially along the shaft 311.

When in static condition illustrated in FIG. 3, the cam surfaces 351, 353 cooperate to lock the driver member 355 to the driven member or tool bit holder 321. In this manner if the shaft 311 is rotated, then the bit holder 321 will simultaneously rotate as a result of being driven by member 355.

The thrust pin 343 and more particularly the stud 347 of the thrust pin 343 is positioned against first and second spherical balls 357, 359 positioned with the transverse passage 319. Each ball 357, 359 has a diameter substantially equal to the radius of the shaft 311 at the passage 319. The balls 357, 359 thus fill the transverse passage 319 along its entire length and are retained in the passage by means of a retaining or kickout sleeve 361.

The kickout sleeve 361 includes a cylindrical counterbore section 362 with an internal diameter greater than the diameter of shaft 311. The counterbore section 362 transforms smoothly to a slide section 363 having a hexagonal internal shape compatible with the hexagonal section 358. Kickout sleeve 361 is thus axially slidable on shaft 311 with cam sleeve 355 and is retained in position by means of a reset spring 365. The kickout sleeve 361 fits within an annular recess 371 defined around the edge of the cam sleeve 355. Spring 365 biases the sleeve 361 against counterbore surface 373. A second biasing spring 375 biases the cam sleeve 355 so as to cause cam surfaces 351, 353 to engage. The springs 365, 375 are both maintained in compression by an adjustment washer 385 which is adjustably positioned by means of an adjustment nut 387 threaded on the shaft 311. The kickout sleeve 361 is normally biased so that hexagonal slide section 363 retains the balls 357, 359 in position as shown in FIG. 3 in the passage 319. Bince annular counterbore section 362 has a diameter greater than the diameter of the shaft 311 when the counterbore section 362 is aligned with the balls 357, 359, the balls 357, 359 may be radially displaceable outward thereby permitting movement either of the stud 357 or of a throttle rod 367 into the passage 319. Rod 367 in this second embodiment is equivalent to rod 52 in the first embodiment.

Thus, in static condition shown in FIG. 3, the balls 357, 359 are impinged by the stud section 357. The opposite sides of the balls 357, 359 impinge against throttle pin or throttle rod 367 projecting into throughbore 317. The throttle rod 367 contacts the fluid control rod 46 and valve 48 which control inlet fluid from chamber 110 to the motor 11. Moving the rod 367 to the right from the position shown in FIG. 3 will cause the rod 367 to open the fluid control valve 48 and provide fluid to operate and power the motor 11. When the rod 367 is in the position shown in FIG. 3, the valve is released and terminates flow of fluid to the motor 11. The rod 367 travels within throughbore 317 which includes a counterbore 318 that limits the amount of travel of the rod 367 to the right in FIG. 3.

3. Operation of the Clutch Assembly of the Second Embodiment

As mentioned previously, FIG. 3 represents the torque control and shutoff mechanism in the static condition prior to use as the fluid powered tool. The rod 367 is thus in a valve 48 off position with the rod 367 retracted to the left in throughbore 317. In order to effect operation of the tool, the blade 337 of tool bit 331 is inserted into a slot of a fastener and caused to translate axially to the right in FIG. 3 so that the body 333 of the bit impinges against the head 345 of the pin 343. This translates the pin 343 and more particularly the stud 347 against the balls 357, 359 which are retained tightly together by the hexagonal slide section 363 of kickout sleeve 361. The balls 357, 359 then impinge against the throttle rod 367 and drive the rod 367 to the right as shown in FIG. 3 causing the rod 367 to open a fluid control valve 48 for the motor 11. The motor 11 then begins to operate (assuming toggle switch 120 is suitably activated) and drives the shaft 311 and keyed drive member or cam sleeve 355. Sleeve 355 is coupled to tool bit holder 321 and drives holder 321. Tool bit holder 321 is keyed to the tool bit 331 which drives the fastener until a predetermined threshold torque value is reached. This torque value is dependent upon the sum of spring forces or biasing forces due the springs 365, 375.

When this threshold torque value is reached, the driving member or cam sleeve 355 will slip over tool bit holder 321 and be moved to the right from the position shown in FIG. 3 due to the interaction of the cam surfaces 351, 353. That is, the torque load will prevent the tool bit 331 from rotating further. The shaft 311 will, however, continue to rotate relative to the bit holder 321. The sleeve 355 will thus rotate with respect to the tool bit holder 321 causing the cam sleeve 355 to move to the right. When the cam sleeve 355 has moved to the right, the kickout sleeve 361 is simultaneously driven to the right in FIG. 5. When this occurs, the balls 357, 359 spread and the stud 347 remains held in position by the tool bit 331. The balls 357, 359 are spread in response to the back pressure force through the rod 367 which forces those balls 357, 359 to move into the transverse passage 319. Movement of the rod 367 to the left will release the inlet valve 48 to the air motor 11 thereby shutting off the supply of fluid to the fluid driven motor 11. When fluid flow is shut off to the motor 11, the shaft 311 ceases to rotate and no additional torque is placed on the fastener through the tool bit 331.

In order to reset the mechanism, the tool is merely removed from the fastener. This releases the axial force on the bit 331. The bit 331 and pin 343 then move to the left to assume the original position shown in FIG. 3. Movement is assisted by virtue of the biasing force associated with the spring 365 which forces the two balls 357, 359 back into passage 319 thereby forcing the stud 347 and thrust pin 343 outwardly. Just after reaching the threshold torque, the cam or kickout sleeve 355 is moved by the spring 375 back to its original or reset position shown in FIG. 3.

In this manner then, the tool is reset ready to be restarted by again positioning the tool bit 331. The tool would again continue to operate until a threshold torque is reached at which time the clutch mechanism, namely, the cam sleeve 355 and cooperative tool bit holder 321, interact to terminate driving action between the shaft 311 and the tool bit holder 321, and simultaneously fluid supply is cut off due to the movement of the rod 367.

Various changes can be made to the structure of the invention while remaining within the spirit thereof. The invention is therefore to be limited only by the following claims and their equivalents.

What is claimed is:

1. A fluid powered tool comprising, in combination:

a housing having a forward end and a rearward end, a fluid driven motor in the housing with a rotary output shaft defining an axis of rotation, a fluid inlet to the housing at the rearward end, first and second fluid inlet passages from the inlet to the motor, the first of said inlet passages connected to direct fluid to drive the motor in a forward direction, and having a motor control inlet valve, and the second inlet passage connected to direct fluid to drive the motor in the reverse direction, a toggle wire trigger means cooperative with both fluid inlet passages to control fluid flow to the motor, a bit holder for a tool bit at the forward end of the tool housing and a clutch mechanism intermediate and connecting the output shaft with the bit holder, the output shaft, bit holder and clutch mechanism being substantially coaxial, (1) said clutch mechanism including a torque responsive, fluid flow start shut-off and reset mechanism, said torque responsive mechanism including:

(a) means for support of the bit holder in the housing to permit both rotary and axial movement;

(b) a driving clutch member keyed at one end to the motor output shaft for simultaneous rotation with the output shaft, said driving clutch member attached at its opposite end to the bit holder to permit simultaneous axial movement with the bit holder and independent rotary movement relative to the bit holder;

(c) clutch engaging means mechanically connecting the driving clutch member to the bit holder for simultaneous rotary movement, said clutch engaging means including at least one biased roller member intermediate the driving clutch member and the bit holder, said biased roller member radially spaced from the axis of rotation and axially movable with respect to one of the driving clutch member and bit holder, said roller member biased into a receiving pocket of the other of the driving clutch member and the bit holder during rotary driving operation of the tool below a torque threshold, said roller member axially translated from said receiving pocket during driving operation of the tool above said torque threshold whereby the bit holder and the driving clutch member rotationally disengage;

(d) an axial counterbore in the driving clutch member extending from the motor output shaft;

(e) a valve control rod in the counterbore mechanically connected at one end to the motor control inlet valve;

(f) valve control rod biasing means for axially biasing the valve control rod toward a motor control valve closed position;

(g) means for simultaneously biasing the driving clutch member axially forward relative to the output shaft;

(h) a radial passage in the driving clutch member intersecting the counterbore;

(i) a radially displaceable member in the radial passage cooperative with the forward end of the valve control rod;

(j) an axially displaceable sleeve over the clutch member radial passage, said sleeve having first and second radial limiting means each separately cooperative with the radially displaceable member to control its position in the passage when aligned with said passage to thereby control the axial position of the valve control rod in the counterbore; and (k) biasing means for normally biasing the sleeve to the first radial limiting position and axially extend the valve control rod toward a valve open position to open the motor control valve and start the motor as the bit holder is axially translated rearwardly when the driving clutch member and bit holder are rotationally engaged, and the sleeve is in the first radial limiting position to hold the valve control rod in the rearward position causing the motor control valve to open;

said biasing means being operative to control and sense torque by permitting disengagement of the rotatably connected driving clutch member and the bit holder when the torque threshold is exceeded and the roller member is axially translated rearwardly to simultaneously translate the sleeve to the second radial limiting position thereby permitting the raidally displaceable member to move radially outward in its passage and release the valve control rod for axially forward movement and closing the motor control valve to terminate operation of the motor; and said biasing means causing reset of the tool when axial force is released on the bit holder permitting the bit holder and driving clutch member to move axially forward in response to means for biasing the driving clutch member and subsequent radial movement of the radially displaceable member in its passage to the first limiting position; and (2) said toggle valve trigger means including:

(a) a first valve seat in the first inlet passage, a cooperative first stem valve having a stem projecting from the housing and a connected first valve cooperative with the first seat;

(b) a second valve seat in the second inlet passage, a cooperative second stem valve having a stem projecting from the housing and a connected second valve cooperative with the second seat; and (c) a toggle member pivotally attached to the housing and reciprocal to engage the first stem or the second stem for opening the first valve or the second valve respectively and defining means for operating the tool in the forward direction only when the toggle member is pivoted to open the valve and the motor control valve is open due to rearward axial movement of the bit holder; and in the reverse direction when the toggle member is pivoted to open the second valve.

2. The tool of claim 1 including a slidable sleeve mounted on at least one of the valve stems of the trigger means, said slidable sleeve dimensionally shorter than the length of the stem, said slidable sleeve defining a seal around the stem to the housing between the inlet passage and the toggle member.

3. The improvement of claim 1 wherein the bit holder includes a transverse flange with a pocket defined therein and the driving clutch member includes an axial bore with both the pocket and bore sized for receipt of the biased roller member.

4. The improvement of claim 3 wherein the axially displaceable sleeve is axially driven by the roller member in the rearward axial direction and by axial displaceable sleeve biasing means in the forward axial direction.

5. The improvement of claim 4 wherein the means for biasing the axially displaceable sleeve and the roller member comprise coaxial spiral spring members fitted over the driving clutch member.

6. The tool of claim 1 wherein the tool includes a handle with the toggle valve trigger means mounted therein, said handle further including an inlet reservoir for pressurized inlet air, said first valve and said second valve each having a valve surface connected to the reservoir and biased by air pressure from the reservoir toward the valve closed position.

7. The tool of claim 1 wherein the tool includes a handle with the toggle valve trigger means mounted therein, said toggle valve trigger means further including a first sleeve slidably mounted on the first stem and a second sleeve slidably mounted on the second stem, each sleeve and each stem valve being in communication with the air inlet and biased thereby to a valve closed position, each sleeve and each stem valve being mechanically engageable and displaceable by the toggle member to simultaneously open air flow passages to the air motor for driving the motor and from the motor for primary and secondary exhaust from the motor.

8. A fluid powered tool comprising, in combination:

a housing having a forward end, a fluid driven motor in the housing with a rotary output shaft defining an axis of rotation, a fluid inlet to the housing, first and second fluid inlet passages from the inlet to the motor, the first of said inlet passages connected to direct fluid to drive the motor in a forward sense, and having a motor control inlet valve, and the second inlet passage connected to direct fluid to drive the motor in the reverse sense, a toggle valve trigger means cooperative with both fluid inlet passages to control fluid flow to the motor, a bit holder for a tool bit at the forward end of the tool housing and a clutch mechanism intermediate and connecting the rotary output shaft with the bit holder, the rotary output shaft, bit holder and clutch mechanism being substantially coaxial;

a fluid shutoff mechanism associated with the clutch mechanism, said fluid shutoff mechanism including:

a rotary shaft extension comprising a clutch member splined to the rotary output shaft and rotatable there within the clutch housing;

a throughbore axially extending through the rotary output shaft and extension; a throttle rod in the throughbore translatable in one axial direction to terminate fluid flow through the fluid inlet to the motor and in the opposite axial direction to allow fluid flow to the motor;

a passage in the shaft extension transverse to the throughbore intermediate the ends of the throughbore and adjacent an end of the throttle rod positioned in the throughbore;

at least one radially displaceable member positioned in the transverse passage for engagement with the throttle rod;

a slidable kickout sleeve on the shaft extension for retaining the radially displaceable member positioned in the passage for engaging the throttle rod;

means biasing the slidable kickout sleeve to the position for retaining the radially displaceable member to engage the throttle rod;

a thrust pin coaxial with the throttle rod and in the throughbore on the opposite side of the transverse passage from the throttle rod, said thrust pin engageable with the tool bit and translatable against the radially displaceable member to drive the throttle rod to open fluid flow through the fluid inlet; and a torque responsive sleeve release mechanism on the shaft extension slidable axially to release the slidable kickout sleeve from retaining the radially displaceable member, said radially displaceable member movable in the passage to permit axial translation of the throttle rod to terminate fluid flow to the fluid inlet, said sleeve release mechanism including a tool bit holder mounted on the shaft extension and rotatable with respect thereto, and a cam sleeve slidably mounted on the shaft extension for axial movement, said cam sleeve biased for engagement with a cam surface on the tool bit holder whereby during normal operation of the tool, the tool bit holder remains fixed relative to the cam sleeve, said tool bit holder rotating relative to said cam sleeve to axially drive the cam sleeve when a threshold torque acts on the tool bit holder; and said toggle valve trigger means including:

a first valve seat in the first inlet passage, a cooperative first stem valve having a stem projecting from the housing and a connected first valve cooperative with the first seat;

a second valve seat in the second inlet passage, a cooperative second stem valve having a stem projecting from the housing and a connected second valve cooperative with the second seat; and a toggle member pivotally attached to the housing and reciprocal to engage the first stem or the second stem for opening the first valve or the second valve respectively to operate the tool in the forward direction only when the toggle member is pivoted to open the first valve and the motor control valve is open due to rearward axial movement of the bit holder and to operate the tool in the reverse direction when the toggle member is pivoted to open the second valve.

* * * * *